US006035153A

United States Patent [19]

Yamawaki et al.

[11] Patent Number: 6,035,153

[45] Date of Patent: Mar. 7, 2000

[54] IMAGE RECORDING APPARATUS WITH EXPOSURE START AND TONER SUPPLY CONTROL

[75] Inventors: Tomoyuki Yamawaki; Toshiharu Doi; Kenzo Fujimoto, all of Hyogo, Japan

[73] Assignee: Fujitsu Limited, Kawasaki, Japan

[21] Appl. No.: 09/182,468

[22] Filed: Oct. 30, 1998

[30] Foreign Application Priority Data

Jun. 19, 1998 [JP] Japan ..... 10-172401

[51] Int. Cl.[7] ..... G03G 15/10

[52] U.S. Cl. ..... 399/58; 399/61; 399/62

[58] Field of Search ..... 399/24, 30, 48, 399/49, 58–62, 51

[56] References Cited

U.S. PATENT DOCUMENTS 5,303,011 4/1994 Noguchi et al. ..... 399/58 X

*Primary Examiner*—William Royer
*Assistant Examiner*—Hoan Tran
*Attorney, Agent, or Firm*—Armstrong, Westerman, Hattori, McLeland, & Naughton

[57] ABSTRACT

An image recording apparatus includes a photosensitive drum on which an electrostatic latent image is formed by laser beam irradiation from an optical unit. A developing unit, which receives toner from a toner feeder and is provided with a toner agitator, supplies toner onto the drum for converting the latent image to a visible image. A toner sensor detects the concentration of the toner within the developing unit for output of a corresponding detection signal. A toner supply controller controls the toner feeder by comparing the output of the toner sensor with a varying standard voltage which varies linearly from a peak level to a steady level. An exposure start controller causes the optical unit to start irradiating the photosensitive drum with light after the rotation of the drum is stabilized but before the output of the toner sensor reaches the peak level.

17 Claims, 6 Drawing Sheets

IMAGE RECORDING APPARATUS WITH EXPOSURE START AND TONER SUPPLY CONTROL

BACKGROUND OF THE INVENTION

1. Field of the Invention

The present invention relates to an image recording apparatus such as an electrophotographic printer which utilizes a developer containing toner and magnetic carrier particles.

2. Description of the Related Art

In an electrophotographic printer which utilizes a developer containing toner and magnetic carrier particles, the toner concentration in a developing unit lowers due to consumption thereof as the printing operation proceeds. To make up for the toner consumption, therefore, a toner sensor is provided for detecting the toner concentration within the developing unit, so that the toner is automatically supplied into the developing unit according to the output voltage of the toner sensor.

Typically, the toner sensor detects the toner concentration on the basis of magnetic permeability, so that the output voltage of the sensor increases with a decreasing toner concentration. At the start of a printing operation, since the developer is not agitated well nor charged sufficiently, the output voltage of the toner sensor tends to become high. More specifically, as shown in FIG. 9 of the accompanying drawings, the output voltage of the toner sensor rises rapidly to a peak level P immediately after starting agitation of the developer and subsequently drops gradually to a steady level at a constant gradient even if the toner concentration is kept constant.

In a prior art printer, therefore, light exposure of the photosensitive drum is started only upon lapse, from the start of developer agitation, of a wait time $t_1$ in which the output voltage of the toner sensor reaches the peak level P. Subsequently, the so-called floating control of toner supply follows wherein the output voltage of the toner sensor is sampled periodically for comparison with a varying standard voltage (similar to the voltage curve shown in FIG. 9) and wherein an amount of toner is supplemented into the developing unit if the output voltage of the toner sensor is higher than the standard voltage by no less than a predetermined amount.

With the prior art printer described above, since the light exposure of the photosensitive drum is started only upon lapse of the wait time $t_1$ of about 7–8 seconds after starting the rotation of the drum, the time required for printing the first page is corresponding prolonged. Further, since the photosensitive drum, the toner agitation rollers and the magnet roll are rotated even during the wait time, the service life of the drum and/or the developer is inevitably shortened.

SUMMARY OF THE INVENTION

It is therefore an object of the present invention to provide an image recording apparatus which is capable of shortening the printing time while also prolonging the service life of the photosensitive drum and the developer.

According to the present invention, there is provided an image recording apparatus comprising: a photosensitive body; an optical unit for irradiating the photosensitive body with light to form an electrostatic latent image; a developing unit for depositing toner on the photosensitive body to convert the latent image to a visible image, the developing unit including a toner agitator; a toner feeder for supplying the toner to the developing unit; a toner sensor for detecting a concentration of the toner within the developing unit for output of a corresponding detection signal; a toner supply controller for controlling the toner feeder by comparing the output of the toner sensor with a varying standard voltage which varies linearly from a peak level to a steady level, the control of the toner feeder being started upon lapse, from the actuation of the toner agitator, of a first period in which the output of the toner sensor substantially reaches the peak level; and an exposure start controller for causing the optical unit to start irradiating the photosensitive body with light upon lapse, from the actuation of the toner agitator, of a second period in which the photosensitive body is stabilized in rotation, the second period being shorter than the first period.

With the above image recording apparatus, since the exposure start controller initiates light exposure after the rotation of the photosensitive body is stabilized but before the varying standard voltage reaches the peak value, the time spent before starting the first page printing is shortened in comparison with the prior art image recording apparatus. As a result, it is possible to shorten the printing time as a whole while also prolonging the service life of the photosensitive body and the developer (which is a mixture of magnetic carrier particles with the toner) due to the reduction of the rotating time of the photosensitive body and a magnet roll before the start of the exposure. In addition, the start of the exposure after stabilizing the photosensitive body prevents a deterioration of the printing quality.

The photosensitive body may be in the form a drum or an endless belt. Normally, the toner is mixed with magnetic carrier particles in the developing unit for transfer of the toner in cooperation with the magnet roll.

Typically, the image recording apparatus of the present invention may be incorporated in a printer or photocopying machine. Alternatively, the image recording apparatus may also be incorporated in a multi-function machine such as a facsimile machine or a combined printing-photocopying machine. Further, the image recording apparatus may be capable of printing color or monochromatic images.

According to a preferred embodiment, the image recording apparatus comprises a standard voltage determiner for determining the varying standard voltage for input to the toner supply controller by calculating a gradient of the standard voltage variation from the peak level to the steady level, the standard voltage determiner utilizing, as the peak level of the varying standard voltage, the output of the toner sensor generated when the first period has lapsed.

According to another preferred embodiment, the image recording apparatus comprises: a page counter for counting pages printed in the first period; and a standard voltage determiner for determining the varying standard voltage for input to the toner supply controller by calculating a gradient of the standard voltage variation from the peak level to the steady level, the standard voltage determiner estimating the peak level of the varying standard voltage on the basis of the count of the page counter.

According to a further preferred embodiment, the image recording apparatus further comprises: a dot counter for counting light dots irradiated on the photosensitive drum in the first period; and a standard voltage determiner for determining the varying standard voltage for input to the toner supply controller by calculating a gradient of the standard voltage variation from the peak level to the steady level, the standard voltage determiner estimating the peak level of the varying standard voltage on the basis of the count of the dot counter.

According to still another preferred embodiment, the image recording apparatus further comprises: an exposure timer for measuring an exposure time in which the photosensitive drum is exposed to light up to the lapse of the first period; and a standard voltage determiner for determining the varying standard voltage for input to the toner supply controller by calculating a gradient of the standard voltage variation from the peak level to the steady level, the standard voltage determiner estimating the peak level of the varying standard voltage on the basis of the measured exposure time. The exposure time as herein used means the time in which the optical unit is operating regardless of whether the laser beam (light) is turned on or off according to the printing data.

In each of the preferred embodiments described above, the output of the toner sensor, the counted number of printed pages, the counted number of exposure light dots or the exposure time may be utilized for calculating the gradient of the varying standard voltage which, in turn, is used for accurately performing the floating control of toner supply. The gradient of the varying standard voltage used for the image recording apparatus of the present invention is somewhat different from that used for the prior art image recording apparatus because the toner is consumed even before the lapse of the first period to lead to a higher peak level. The output of the toner sensor, the counted number of printed pages, the counted number of exposure light dots or the exposure time may be utilized for determining or estimating the thus elevated peak level which, in turn, is used for adjusting the standard voltage.

According to a preferred embodiment, the image recording apparatus further comprises an after-treatment controller for keeping the toner feeder and the toner agitator operating even after completion of printing when the output of the toner sensor generated upon the lapse of the first period is no less than a predetermined value.

According to another preferred embodiment, the image recording apparatus further comprises: a page counter for counting pages printed in the first period; and an after-treatment controller for keeping the toner feeder and the toner agitator operating even after completion of printing when the count of the page counter is no less than a predetermined value.

According to a further preferred embodiment, the image recording apparatus further comprises: a dot counter for counting light dots irradiated on the photosensitive drum in the first period; and an after-treatment controller for keeping the toner feeder and the toner agitator operating even after completion of printing when the count of the dot counter is no less than a predetermined value.

According to still another preferred embodiment, the image recording apparatus further comprises: an exposure timer for measuring an exposure time in which the photosensitive drum is exposed to light up to the lapse of the first period; and an after-treatment controller for keeping the toner feeder and the toner agitator operating even after completion of printing when the measured exposure time is no less than a predetermined value.

According to a further preferred embodiment, the image recording apparatus further comprises an after-treatment controller for keeping the toner feeder and the toner agitator operating for an after-treatment period even after completion of printing, the after-treatment period being determined according to the output of the toner sensor generated upon the lapse of the first period.

According to a further preferred embodiment, the image recording apparatus further comprises: a page counter for counting pages printed in the first period; and an after-treatment controller for keeping the toner feeder and the toner agitator operating for an after-treatment period even after completion of printing, the after-treatment period being determined according to the count of the page counter.

According to a further preferred embodiment, the image recording apparatus further comprises: a dot counter for counting light dots irradiated on the photosensitive drum in the first period; and an after-treatment controller for keeping the toner feeder and the toner agitator operating for an after-treatment period even after completion of printing, the after-treatment period being determined according to the count of the dot counter.

According to a further preferred embodiment, the image recording apparatus further comprises: an exposure timer for measuring an exposure time in which the photosensitive drum is exposed to light up to the lapse of the first period; and an after-treatment controller for keeping the toner feeder and the toner agitator operating for an after-treatment period even after completion of printing, the after-treatment period being determined according to the measured exposure time.

According to a further preferred embodiment, the image recording apparatus further comprises an after-treatment controller for keeping the toner feeder and the toner agitator operating for an after-treatment period even after completion of printing when the output of the toner sensor generated upon the lapse of the first period is no less than a predetermined value, the after-treatment period being determined according to the output of the toner sensor.

According to a further preferred embodiment, the image recording apparatus further comprises: a page counter for counting pages printed in the first period; and an after-treatment controller for keeping the toner feeder and the toner agitator operating for an after-treatment period even after completion of printing when the count of the page counter is no less than a predetermined value, the after-treatment period being determined according to the count of the page counter.

According to a further preferred embodiment, the image recording apparatus further comprises: a dot counter for counting light dots irradiated on the photosensitive drum in the first period; and an after-treatment controller for keeping the toner feeder and the toner agitator operating for an after-treatment period even after completion of printing when the count of the dot counter is no less than a predetermined value, the after-treatment period being determined according to the count of the dot counter.

According to a further preferred embodiment, the image recording apparatus further comprises: an exposure timer for measuring an exposure time in which the photosensitive drum is exposed to light up to the lapse of the first period; and an after-treatment controller for keeping the toner feeder and the toner agitator operating for an after-treatment period even after completion of printing when the measured exposure time is no less than a predetermined value, the after-treatment period being determined according to the measured exposure time.

The after-treatment controller in each of the foregoing embodiments causes the toner feeder and the toner agitator to continue operating even after completion of printing. In other words, the floating control of the toner continues for a while even after the printing operation finishes. Such an after-treatment, which is advantageous for keeping a suitable amount of toner within the developing unit, is provided in view of the fact that the supplemented amount of the toner may not catch up with the consumed amount if the time for the floating control is too short as in the case where the number of pages printed after the start of the floating control is smaller than the number of pages printed before the start of the floating control. The after-treatment may be performed only when the output of the toner sensor, the counted pages, the counted light dots or the measured exposure time is no less than a predetermined value, thereby preventing the after-treatment from being performed at an unnecessary time. Further, the time or period for the after-treatment may be determined according to the output of the toner sensor, the counted pages, the counted light dots or the measured exposure time, thereby balancing the supplemented amount of toner with the consumed amount.

Other features and advantages of the present invention should become clear from the detailed description to be made hereinafter referring to the accompanied drawings.

DETAILED DESCRIPTION OF THE PREFERRED EMBODIMENTS

The preferred embodiments of the present invention will be specifically described below with reference to the accompanying drawings.

Figure 1:
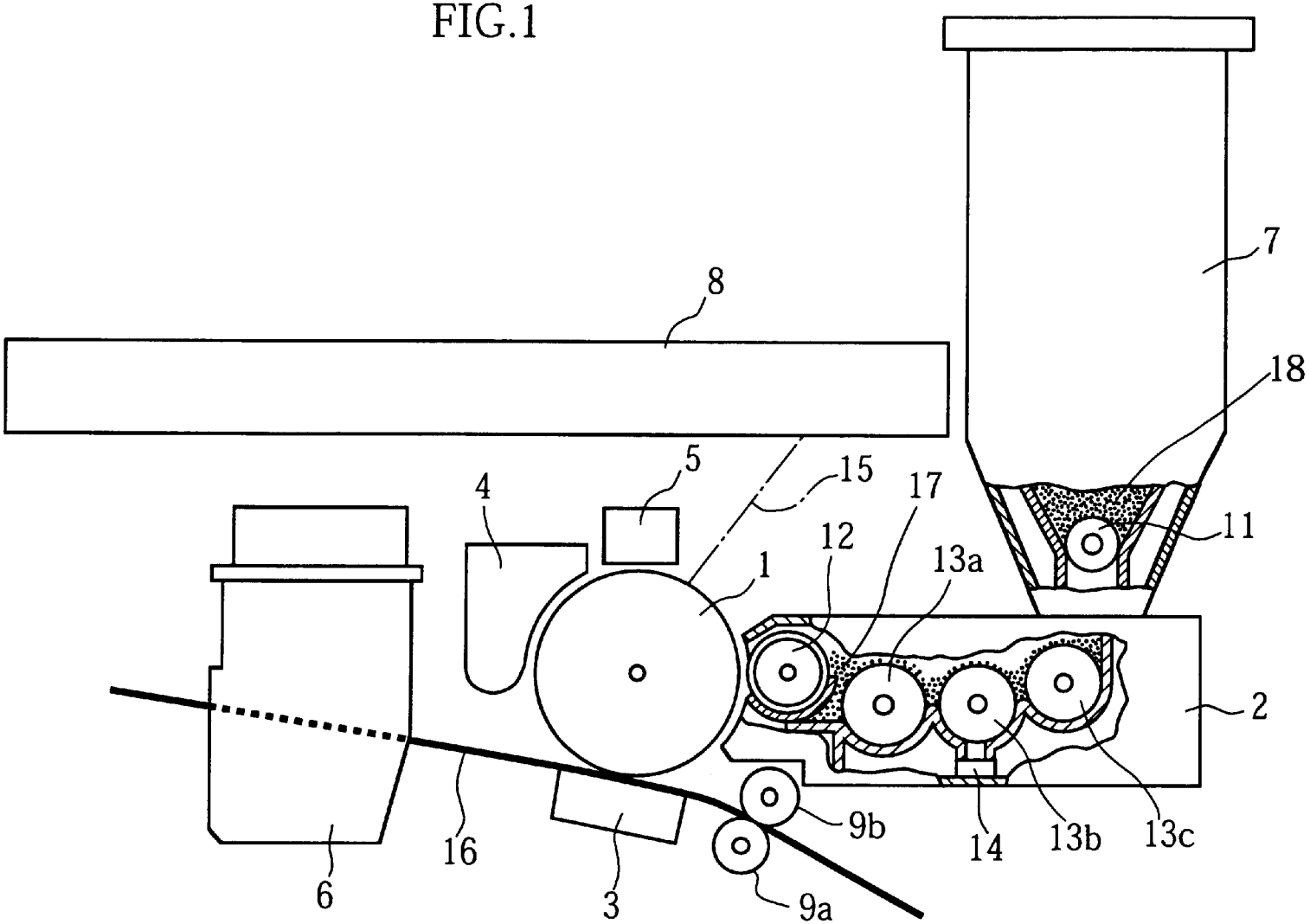
FIG. 1 is a schematic view showing a printer incorporating an image recording apparatus according to a first embodiment of the present invention.

FIG. 1 shows a printer which incorporates an image recording apparatus according to a first embodiment of the present invention. As shown in this figure, the printer comprises a photosensitive drum 1, a developing unit 2, an image transfer/charge removal unit 3, a cleaning blade or scraper 4, a charging unit 5, a fixing unit 6, a toner hopper 7, an optical unit 8, and a paper transfer rollers 9*a*, 9*b*. The interior of the toner hopper 7 is provided with a toner supply roller 11. The interior of the developing unit 2 is provided with three toner agitating rollers 13*a*, 13*b*, 13*c* and a toner sensor 14.

The cylindrical surface of the photosensitive drum 1 is electrostatically charged by means of the charging unit 5 and irradiated with a laser beam 15 from the optical unit 8 for exposure. This results in formation of an electrostatic latent image on the cylindrical surface of the photosensitive drum 1. The latent image is rendered visible through development (i.e., deposition of toner 18) at the developing unit 2. The image transfer/charge removal unit 3 causes the visible image (toner 18) on the photosensitive drum 1 to be transferred onto a recording paper 16 which is fed by the paper transfer rollers 9*a*, 9*b* rotating in synchronism with the photosensitive drum 1. The fixing unit 6 heats the transferred toner 18 (visible image) for fixation on the recording paper 16. The electrostatic charge remaining on the cylindrical surface of the photosensitive drum 1 is removed by the image transfer/charge removal unit 3, whereas the remaining portion of the toner 18 on the drum 1 is scraped off by the cleaning blade 4.

On the other hand, the toner 18 supplied from the hopper 7 into the developing unit 2 due to rotation of the toner supply roller 11 is agitated and transferred toward a magnet roll 12, together with magnetic carrier particles, by the toner agitating rollers 13*a*–13*c*. The combination of the toner 18 and the carrier particles provides a two-component developer 17. The magnet roll 12 under rotation carries the developer 17 to a position adjacent to the cylindrical surface of the photosensitive drum 1 for electrostatic deposition of the toner 18 to form a visible image. The toner sensor 14 is disposed under the toner agitating roller 13*b* for determining the toner concentration within the developing unit 2. The sensor 14 has a built-in coil for output of a detection voltage in accordance with the magnetic permeability of the developer 17.

Figure 2:
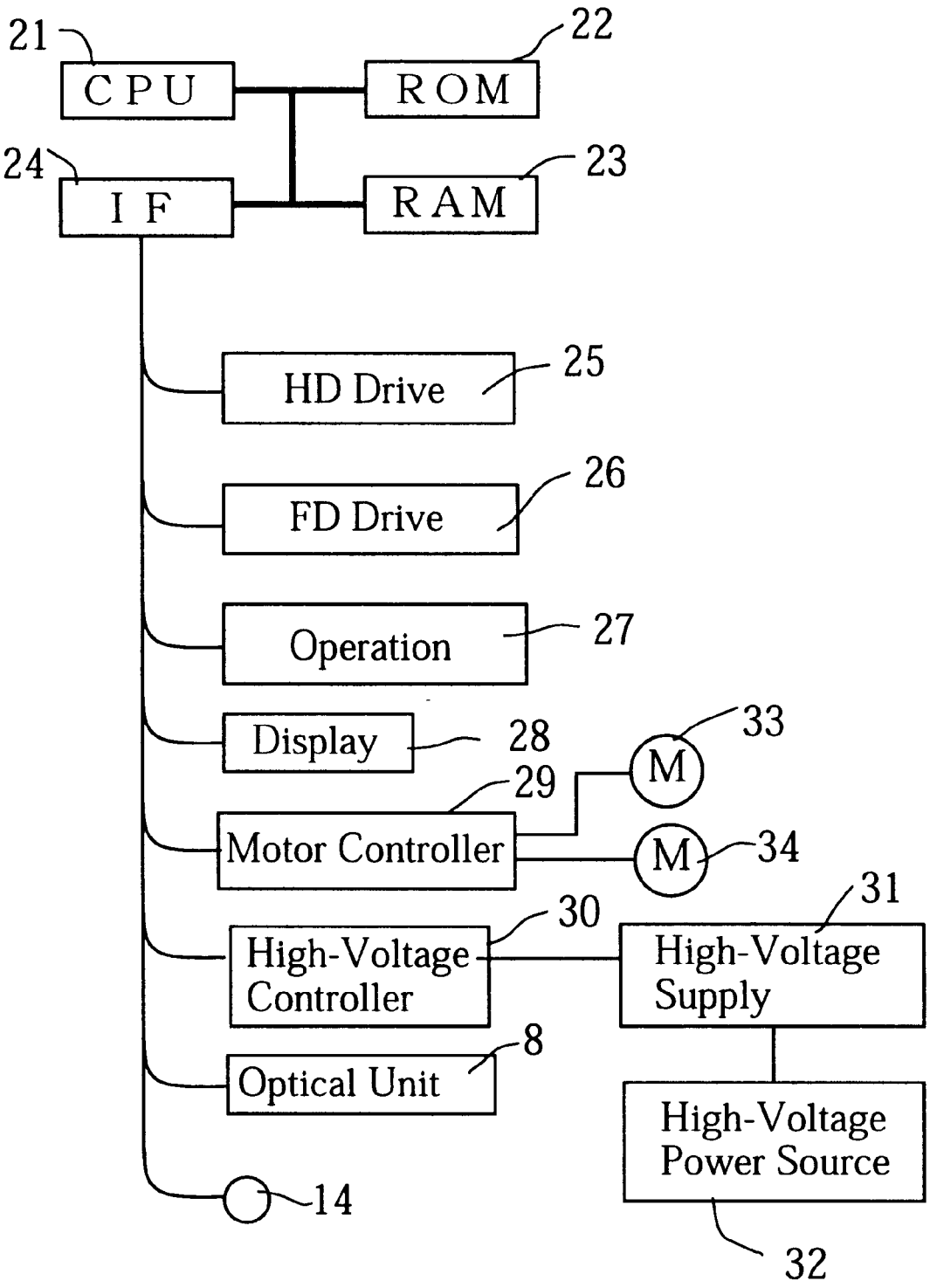
FIG. 2 is a circuit block diagram of the same printer.

FIG. 2 is a circuit block diagram of the printer shown in FIG. 1. As shown in FIG. 2, the printer includes a CPU (central processing unit) 21, a ROM (read only memory) 22, a RAM (random access memory) 23, an interface 24, a hard disk drive 25, a flexible disk drive 26, an operation unit 27, a display unit 28, a motor controller 29, and a high-voltage controller 30. The optical unit 8 and the toner sensor 14, described previously, are connected to the interface 24. Similarly, the hard disk drive 25, the flexible disk drive 26, the operation unit 27, the display unit 28, the motor controller 29 and the high-voltage controller 30 are also connected to the interface 24. The high-voltage controller 30 is connected to a high-voltage supplier 31 which, in turn, is connected to a high-voltage power source 32. The motor controller 29 is connected to motors 33, 34.

The CPU 21 provides overall control of the printer.

The ROM 22 stores basic programs needed for the operation of the printer.

The RAM 23 provides a working region for the CPU 21 while storing various kinds of data.

The interface 24 controls communication between the CPU 31 and each of the peripheral units.

The hard disk drive 25 performs data writing and reading relative to a hard disk (not shown). The data to be written in the non-illustrated harddisk include printing data supplied from flexible disk (not shown) loaded at the flexible disk drive 26 and/or from a computer (not shown).

The flexible disk drive 26 perform data writing and reading relative to a flexible disk (not shown).

The operation unit 27 includes a plurality of key switches (not shown) for input of the instructions of a user.

The display unit 28 may include an LCD (liquid crystal display) for display of various pieces of information.

The motor controller 29 controls the motor 33 which drives the photosensitive drum 1, the magnet roll 12 and the toner agitating roller 13*a*–13*c*. The motor controller 29 also controls the other motor 34 which drives the toner supply roller 11.

The high-voltage controller 30 controls the high-voltage supplier 31 which supplies the developing unit 2 and the charging unit 5 with a high voltage from the high-voltage power source 32.

The optical unit 8 irradiates the photosensitive drum 1 with a laser beam 15 (FIG. 1) for forming an electrostatic image thereon in accordance with the received printing data.

Figure 3:
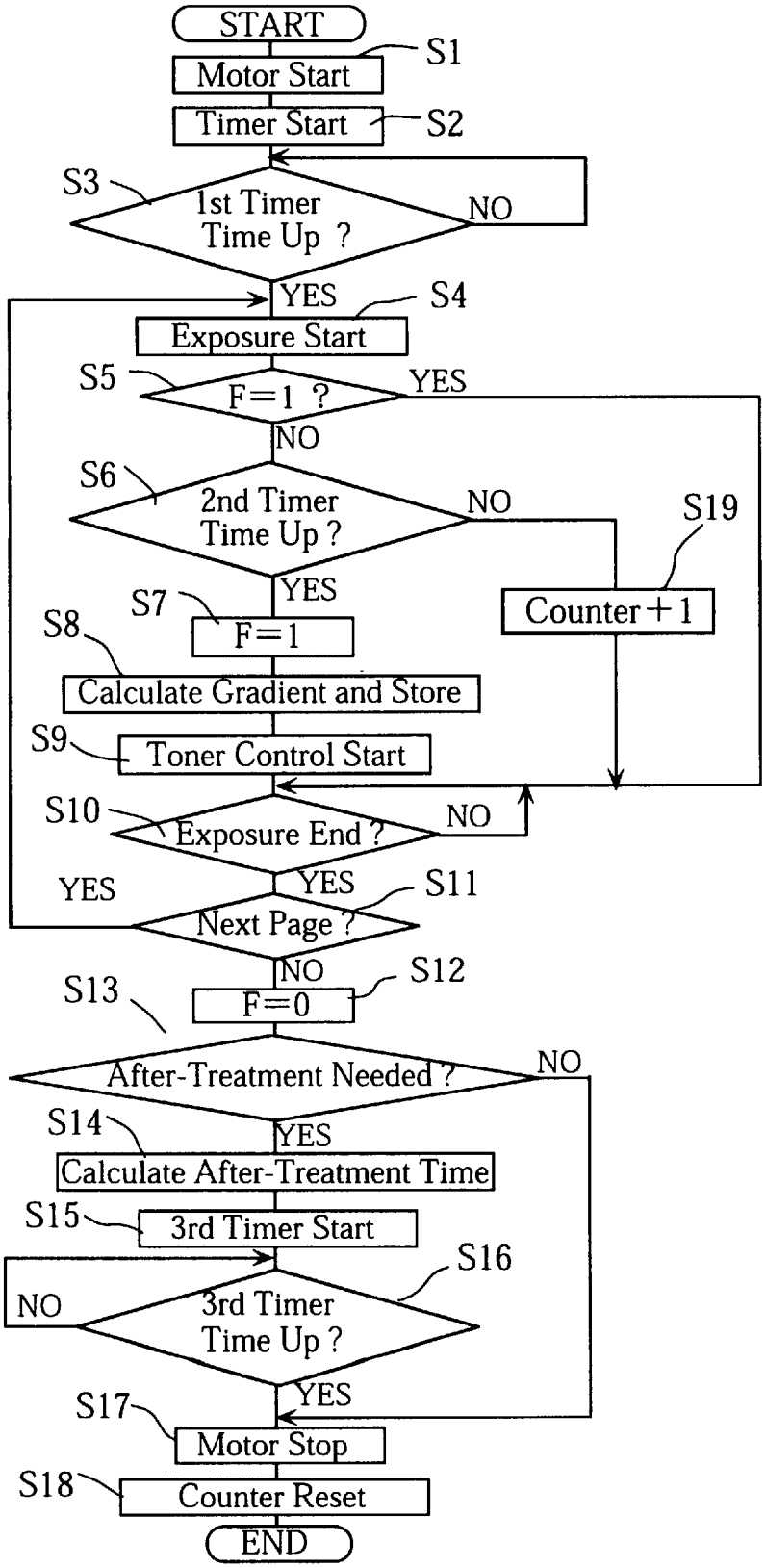
FIG. 3 is a flow diagram showing the printing operation of the same printer.

Next, the operation of the printer is described with reference to the flow diagram of FIG. 3.

When the printing operation starts, the CPU 21 first controls the motor controller 29 to actuate the motor 33 (Step S1). As a result, the photosensitive drum 1, the magnet roll 12 and the toner agitating rollers 13*a*–13*c* start rotating.

Then, the CPU 21 actuates a first timer and a second timer (Step S2). The first timer is used for determining the lapse of a rotation stabilization time of about 2 seconds needed for stabilizing the rotation of the photosensitive drum 1, whereas the second timer is used for determining the lapse of a peak-reaching time of about 7 seconds required before the output voltage of the toner sensor 14 reaches a peak value. Each of the first and second timers may be realized by a counter which counts clock pulses, whereas the rotation stabilization time and the peak-reaching time are set by the CPU 21.

Then, the CPU 21 determines whether the rotation stabilization time set by the CPU 21 has lapsed at the first timer (Step S3).

Figure 4:
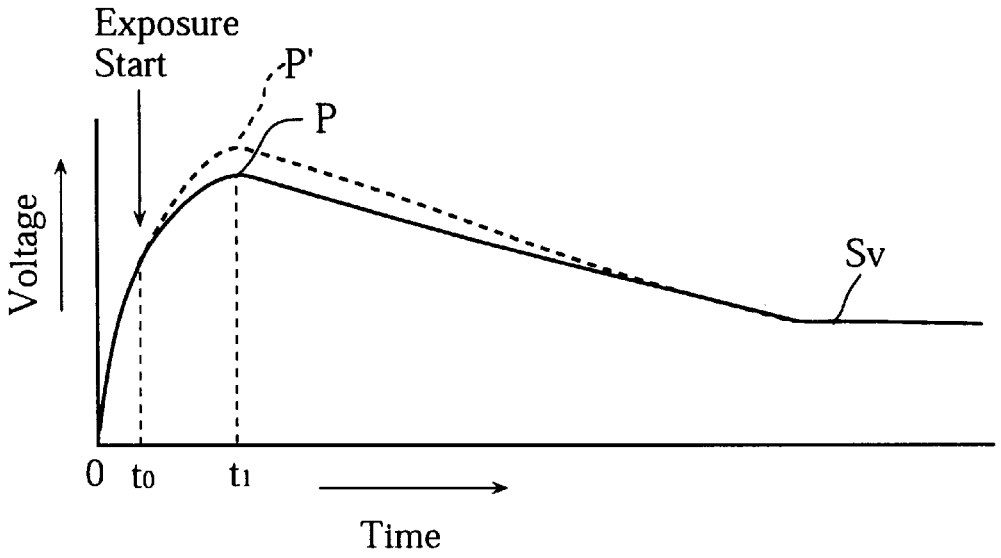
FIG. 4 is a graph illustrating the standard voltage variation which is used for floating control of toner supply.

If YES in Step S3, the CPU 21 starts light exposure (Step S4). Specifically, the CPU 21 reads out the printing data from the hard disk (not shown) for transmission to the optical unit 8 and causes the optical unit 8 to irradiate the photosensitive drum 1 with the laser beam 15 for forming an electrostatic latent image. Thus, as shown in FIG. 4, the printer starts printing at time $t_0$ (about 2 seconds after starting the rotation of the photosensitive drum 1) which is earlier than time $t_1$ (about 7 second after the motor actuation) at which the output voltage of the toner sensor 14 reaches an estimated peak P'. At time $t_0$, the rotation of the drum 1 has sufficiently stabilized.

Then, the CPU 21 determines whether flag F is ON (Step S5). The flag F, which is stored in the RAM 23, indicates whether the gradient of an estimated standard voltage variation used for floating control has been already calculated.

If the flag F is OFF (NO in Step S5), the CPU 21 determines whether the peak-reaching time set by the CPU 21 has lapsed at the second timer (Step S6).

If YES in Step S6, the CPU 21 changes the flag F to ON (Step S7) and calculates the gradient of the estimated standard voltage variation for storage in the RAM (Step S8). In the graph of FIG. 4, the standard voltage variation used for the prior art floating control is represented by a solid line, whereas the estimated standard voltage variation used for the floating control of the present invention is represented by a broken line. As shown in FIG. 4, the peak voltage P' of the estimated standard voltage variation is higher than the peak P of the standard voltage variation used for the prior art floating control because the printing operation (i.e., consumption of the toner) starts at the rotation stabilization time $T_o$ earlier than the peak-reaching time $T_1$. In the illustrated embodiment, therefore, the peak voltage P' is estimated on the basis of the count of a page counter which is provided for counting the number of the pages (papers) which have been already printed after starting the printing operation. The page counter may be realized by the CPU 21 which increments a predetermined address of the RAM 23 by one upon completion of printing each page. The peak voltage P' thus estimated is used for calculating the gradient of a straight line extending from the peak P' to a steady voltage Sv.

Then, the CPU 21 starts the floating control of the toner (Step S9). Specifically, the CPU 21 samples the output voltage of the toner sensor 14 periodically at an interval of 0.5 seconds for comparison with the estimated standard voltage (as calculated in Step S8). If the sampled output voltage is higher than the estimated standard voltage by no less than a predetermined value, the CPU 21 causes the motor controller 29 (FIG. 2) to drive the motor 34. As a result, the toner supply roller 11 (FIG. 1) rotates to supplement a suitable amount of the toner 18 from the hopper 7 into the developing unit 2.

Then, the CPU 21 determines whether the light exposure has finished (Step S10). Specifically, the CPU 21 determines whether the radiation of the laser beam 15 for one page of printing data has finished.

If YES in Step S10, the CPU 21 then determines whether it is necessary to continue printing for the next page (Step S11).

If $N_o$ in Step S11, the CPU 21 changes the flag F to OFF (Step S12).

Then, the CPU 21 determines whether it is necessary to perform an after-treatment (Step S13). Specifically, the CPU 21 checks whether the count of the page counter which counts the number of pages before the second timer becomes due is no less than a predetermined value.

If YES in Step S13, the CPU 21 then calculates an after-treatment time on the basis of the count of the page counter (Step S14).

Then, the CPU 21 sets the calculated after-treatment time for a third timer and actuates the third timer (Step S15). Similarly to the first and second timers, the third timer may also be realized by a counter which counts clock pulses.

Then, the CPU 21 determines whether the third timer becomes due (Step S16).

If NO in Step S16, the CPU 21 waits, without stopping the motor 33, until the third timer is due. Thus, even after the completion of the printing operation, the photosensitive drum 1, the magnet roll 12 and the toner agitation rollers 13*a*–13*c* keep on rotating to continue the floating control during the after-treatment time (i.e., until the third timer becomes due). Such an after-treatment is provided in view of the fact that the supplemented amount of the toner may not catch up with the consumed amount if the time for the floating control is too short as in the case where the number of pages printed after the start of the floating control is smaller than the number of pages printed before the start of the floating control. If the toner concentration is already appropriate, the continuation of the floating control in the after-treatment does no harm because no toner is supplemented.

If the third timer is due in Step S16 (YES in Step S16), the CPU 21 causes the motor controller 29 to stop the motor 33 (Step S17).

Then, the CPU 21 resets the page counter and terminates the printing routine.

In Step S13, if no after-treatment is required (NO in Step S13), Step S17 follows to skip the after-treatment.

In Step S11, if the printing for the next page is required (YES in Step S11), Step S4 follows in loop to start the printing of the next page.

In Step S10, if the light exposure has not finished (NO in Step S10), the CPU 21 waits until the light exposure finishes.

In Step S6, if the second timer is not due (NO in Step S6), the CPU 21 adds one to the present value of the page counter (Step S19) and proceeds to Step S10. In this way, before the second timer becomes due, the printing operation continues without supplementing the toner.

In Step S5, if the flag F is ON (NO in Step S5), the floating control is already on-going, and therefore Step S10 follows.

In Step S3, if the first timer is not due (NO in Step S3), the CPU 21 waits until the first timer becomes due. In this way, the light exposure is deferred until the rotational speed of the photosensitive drum 1 is stabilized, so that a deterioration of the printing quality can be prevented.

Figure 5:
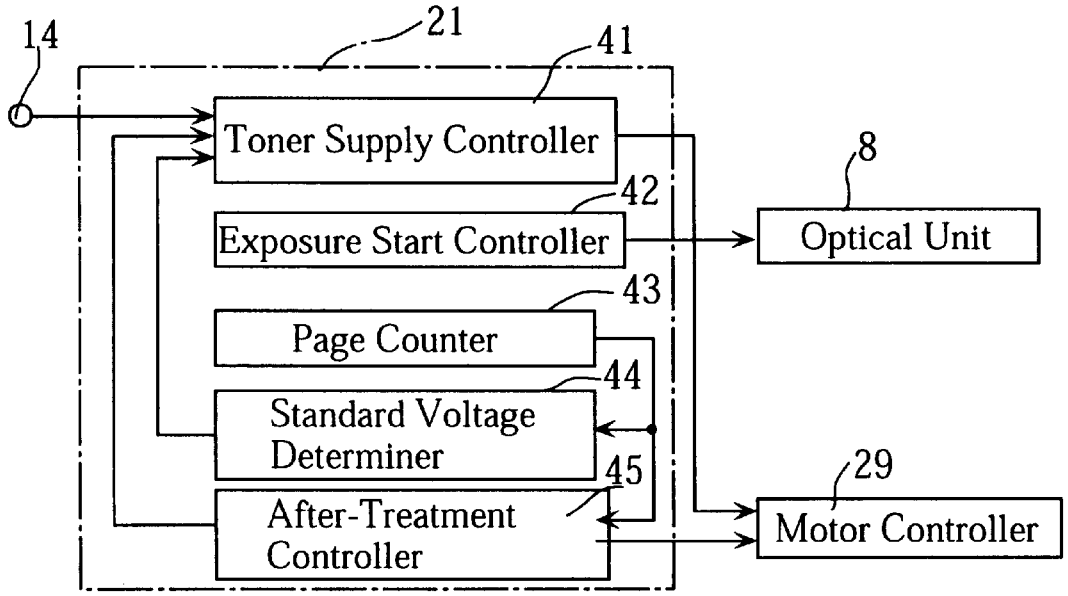
FIG. 5 is a view illustrating the various functions performed by a CPU of the printer according to the first embodiment.

As described above and as shown in FIG. 5, the CPU 21 operating on the basis of the predetermined programs functions as a toner supply controller 41, as an exposure start controller 42, as a page counter 43, as a standard voltage determiner 44 and as a after-treatment controller 45. The toner supply controller 41 compares the output voltage of the toner sensor 14 with the varying standard voltage (as calculated by the standard voltage determiner 43) for causing the motor controller 29 to control the motor 34 in accordance with the results of the comparison after the second timer becomes due. The exposure start controller 42 controls the optical unit 8 for initiating the light irradiation to the photosensitive drum 1 when the first timer becomes due. The page counter 43 counts the number of pages which are printed until the second timer becomes due. The standard voltage determiner 44 calculates the gradient of the voltage drop from the peak voltage P' (which is estimated on the basis of the count of the page counter) to the steady voltage Sv to determine the varying standard voltage for input to the toner supply controller 41. After finishing the printing operation, the after-treatment controller 45 keeps the motor 33 rotating for a variable after-treatment period while continuing the floating control if the count of the page counter 43 is no less than a predetermined value, the after-treatment period being determined according to the count of the page counter 43.

The after-treatment controller 45 may be modified in such a way that the after-treatment is performed for a fixed period regardless of the count of the page counter 43 as long as the count is no less than a predetermined value.

Alternatively, the after-treatment controller 45 may also be modified in such a way that the after-treatment is performed for a variable period which is determined according to the count of the page counter regardless of whether the count is higher or lower than or equal to a predetermined value.

Figure 6:
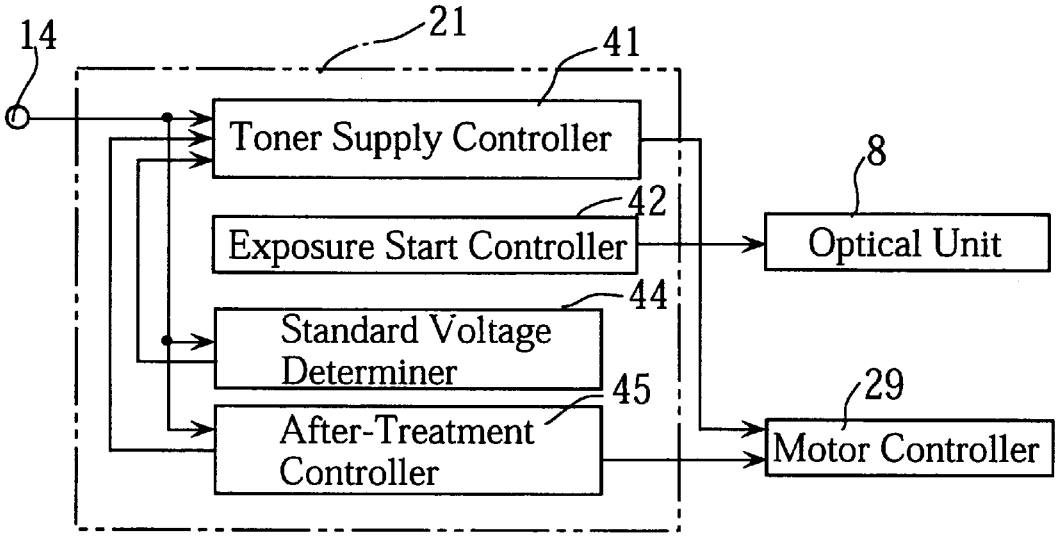
FIG. 6 is a view illustrating the various functions performed by a CPU of a printer according to a second embodiment of the present invention.

FIG. 6 is a functional block diagram showing a second embodiment of the present invention. The second embodiment of FIG. 6 is similar to the first embodiment shown in FIG. 5 but differs therefrom in that the page counter 43 provided for the first embedment is omitted.

According to the second embodiment, the standard voltage determiner 44 utilizes, as the peak voltage P' (see FIG. 4), the output voltage of the toner sensor 14 when the second timer becomes due, and calculates the gradient of a voltage drop from the peak voltage P' to the steady voltage Sv for determining the standard voltage variation used to perform the floating control of the toner supply. Further, after finishing the printing operation, the after-treatment controller 45 keeps the motor 33 rotating for a variable after-treatment period while continuing the floating control if the peak voltage P' is no less than a predetermined value, the variable period being determined according to the peak voltage P'.

The after-treatment controller 45 in the second embodiment may be modified in such a way that the after-treatment is performed for a fixed period regardless of the peak voltage P' as long as the peak voltage P' is no less than a predetermined value.

Alternatively, the after-treatment controller 45 in the second embodiment may also be modified in such a way that the after-treatment is performed for a variable period which is determined according to the peak voltage P' regardless of whether the peak voltage P' is higher or lower than or equal to a predetermined value.

Figure 7:
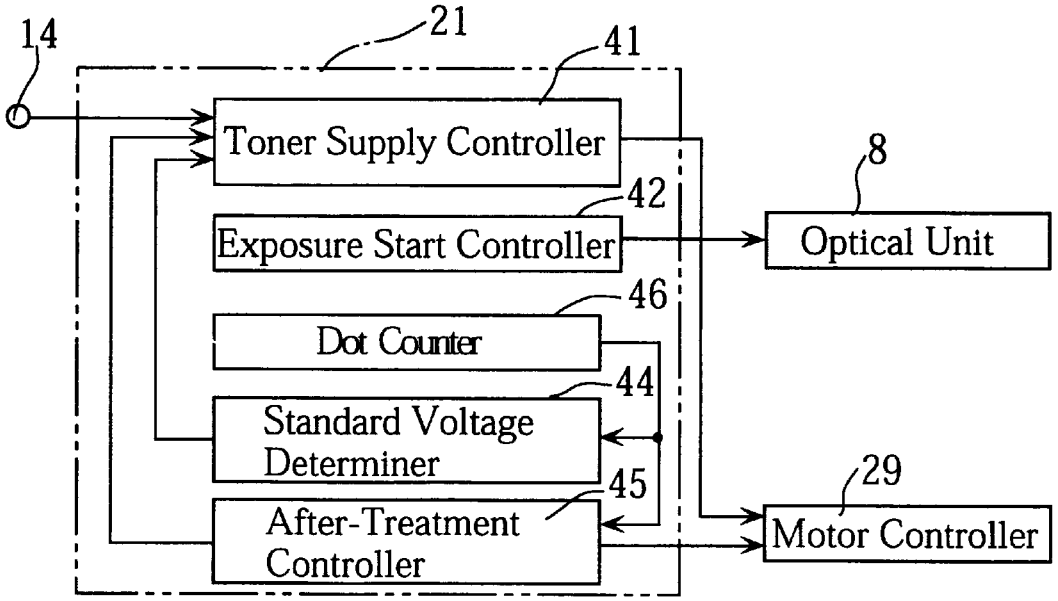
FIG. 7 is a view illustrating the various functions performed by a CPU of a printer according to a third embodiment of the present invention.

FIG. 7 is a functional block diagram showing a third embodiment of the present invention. The third embodiment of FIG. 7 is similar to the first embodiment shown in FIG. 5 but differs therefrom in that the page counter 43 provided for the first embodiment is replaced with a dot counter 46 which counts the number of light exposure or irradiation dots formed by the optical unit 8 until the second timer becomes due.

According to the third embodiment, the standard voltage determiner 44 utilizes the count of the dot counter 46 for estimating the peak voltage P' (see FIG. 4), and calculates the gradient of a voltage drop from the estimated peak voltage P' to the steady voltage Sv for determining the standard voltage variation used to perform the floating control of the toner supply. Further, after finishing the printing operation, the after-treatment controller 45 keeps the motor 33 rotating for a variable after-treatment period while continuing the floating control if the count of the dot counter is no less than a predetermined value, the variable period being determined according to the count of the dot counter 46.

The after-treatment controller 45 in the third embodiment may be modified in such a way that the after-treatment is performed for a fixed period regardless of the count of the dot counter 46 as long as the count is no less than a predetermined value.

Alternatively, the after-treatment controller 45 in the third embodiment may also be modified in such a way that the after-treatment is performed for a variable period which is determined according to the count of the dot counter regardless of whether the count is higher or lower than or equal to a predetermined value.

Figure 8:
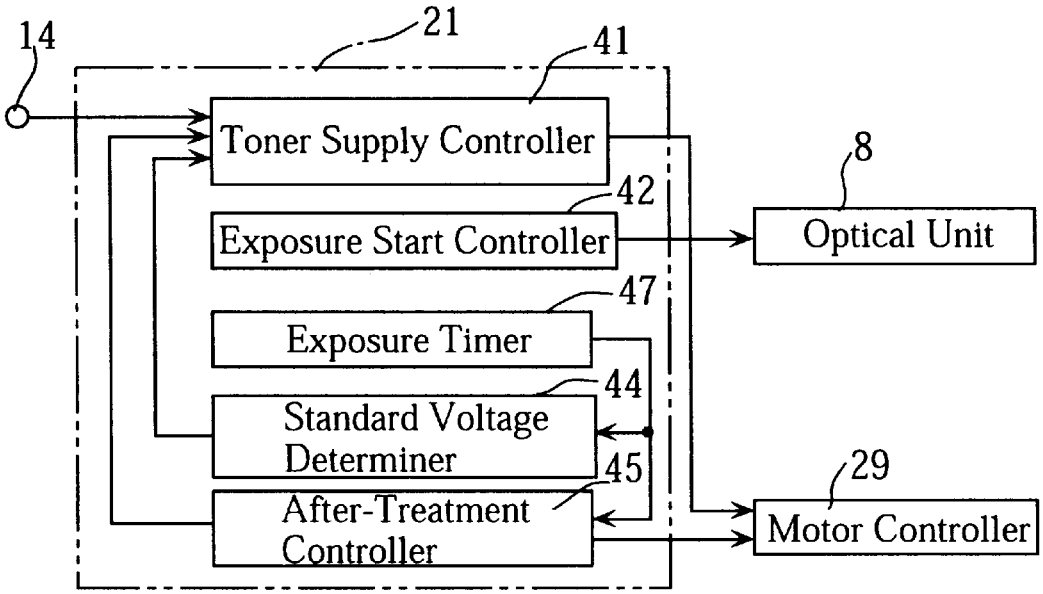
FIG. 8 is a view illustrating the various functions performed by a CPU of a printer according to a fourth embodiment of the present invention.
Figure 9:
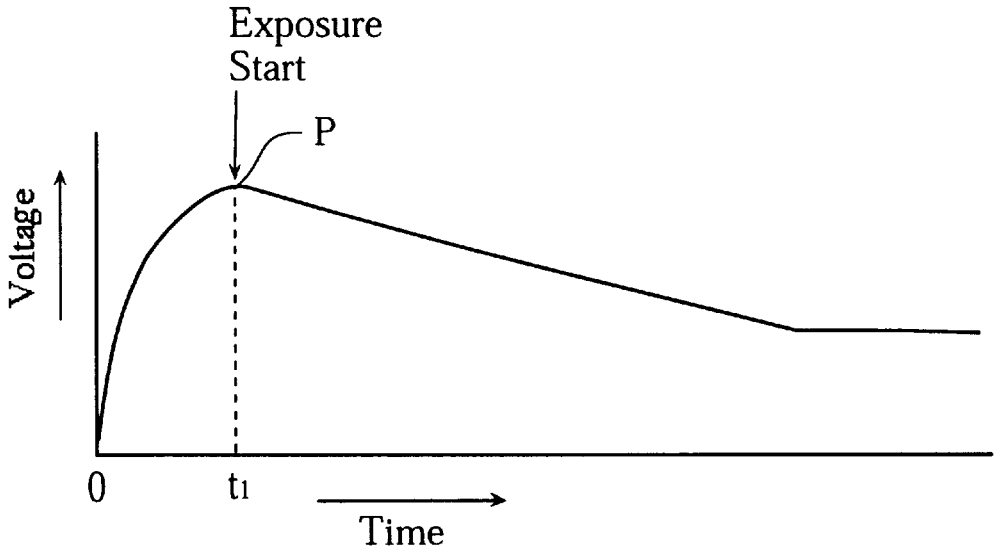
FIG.9 Prior Art
FIG. 9 is a graph illustrating the standard voltage variation which is used for floating control of toner supply in a prior art printer.

FIG. 8 is a functional block diagram showing a fourth embodiment of the present invention. The fourth embodiment of FIG. 8 is similar to the first embodiment shown in FIG. 5 but differs therefrom in that the page counter 43 provided for the first embodiment is replaced with an exposure timer 47 for determining the light exposure time spent until the second timer becomes due.

According to the fourth embodiment, the standard voltage determiner 44 utilizes the exposure time determined by the exposure timer 47 for estimating the peak voltage P' (see FIG. 4), and calculates the gradient of a voltage drop from the estimated peak voltage P' to the steady voltage Sv for determining the standard voltage variation used to perform the floating control of the toner supply. Further, after finishing the printing operation, the after-treatment controller 45 keeps the motor 33 rotating for a variable after-treatment period while continuing the floating control if the determined exposure time is no less than a predetermined value, the variable period being determined according to the exposure time.

The after-treatment controller 45 in the fourth embodiment may be modified in such a way that the after-treatment is performed for a fixed period regardless of the light exposure time as long as the exposure time is no less than a predetermined value.

Alternatively, the after-treatment controller 45 in the fourth embodiment may also be modified in such a way that the after-treatment is performed for a variable period which is determined according to the exposure time regardless of whether the exposure is longer or shorter than or equal to a predetermined value.

According to any one of the foregoing embodiments, since the exposure start controller 41 initiates light exposure after the rotation of the photosensitive drum 1 is stabilized but before the varying standard voltage reaches a peak value, the time spent before starting the first page printing is shortened in comparison with the prior art image recording apparatus. As a result, it is possible to shorten the printing time as a whole while also prolonging the service life of the photosensitive drum 1 and the developer 17 due to the reduction of the rotating time of the drum 1 and the magnet roll 12 before the start of the exposure. In addition, the start of the exposure after stabilizing the photosensitive drum prevents a deterioration of the printing quality.

The preferred embodiments of the present invention being thus described, it is obvious that the same may be varied in various way. For instance, the photosensitive drum 1, the magnet roll 12 and the toner agitation rollers 13*a*–13*c*, all of which are driven by the single motor 33 through a non-illustrated transmission mechanism, may be separately driven by different motors. Further, the photosensitive drum 1 does not need to be rotated together with the magnet roller 12 and the toner agitation rollers 13*a*–13*c* in the after-treatment. Such variations should not be regarded as a departure from the spirit and scope of the invention, and all such variations as would be obvious to those skilled in the art are intended to be included within the scope of the appended claims.

We claim:

1. An image recording apparatus comprising:

a photosensitive body;

an optical unit for irradiating the photosensitive body with light to form an electrostatic latent image;

a developing unit for depositing toner on the photosensitive body to convert the latent image to a visible image, the developing unit including a toner agitator;

a toner feeder for supplying the toner to the developing unit;

a toner sensor for detecting a concentration of the toner within the developing unit for output of a corresponding detection signal;

a toner supply controller for controlling the toner feeder by comparing the output of the toner sensor with a varying standard voltage which varies linearly from a peak level to a steady level, the control of the toner feeder being started upon lapse, from the actuation of the toner agitator, of a first period in which the output of the toner sensor substantially reaches the peak level; and an exposure start controller for causing the optical unit to start irradiating the photosensitive body with light upon lapse, from the actuation of the toner agitator, of a second period in which the photosensitive body is stabilized in rotation, the second period being shorter than the first period, wherein the toner feeder starts supplying the toner to the developing unit only upon lapse of the first period.

2. The image recording apparatus according to claim 1, further comprising a standard voltage determiner for determining the varying standard voltage for input to the toner supply controller by calculating a gradient of the standard voltage variation from the peak level to the steady level, the standard voltage determiner utilizing, as the peak level of the varying standard voltage, the output of the toner sensor generated when the first period has lapsed.

3. The image recording apparatus according to claim 1, further comprising:

a page counter for counting pages printed in the first period; and a standard voltage determiner for determining the varying standard voltage for input to the toner supply controller by calculating a gradient of the standard voltage variation from the peak level to the steady level, the standard voltage determiner estimating the peak level of the varying standard voltage on the basis of the count of the page counter.

4. The image recording apparatus according to claim 1, further comprising:

a dot counter for counting light dots irradiated on the photosensitive drum in the first period; and a standard voltage determiner for determining the varying standard voltage for input to the toner supply controller by calculating a gradient of the standard voltage variation from the peak level to the steady level, the standard voltage determiner estimating the peak level of the varying standard voltage on the basis of the count of the dot counter.

5. The image recording apparatus according to claim 1, further comprising:

an exposure timer for measuring an exposure time in which the photosensitive drum is exposed to light up to the lapse of the first period; and a standard voltage determiner for determining the varying standard voltage for input to the toner supply controller by calculating a gradient of the standard voltage variation from the peak level to the steady level, the standard voltage determiner estimating the peak level of the varying standard voltage on the basis of the measured exposure time.

6. The image recording apparatus according to claim 1, further comprising an after-treatment controller for keeping the toner feeder and the toner agitator operating even after completion of printing when the output of the toner sensor generated upon the lapse of the first period is no less than a predetermined value.

7. The image recording apparatus according to claim 1, further comprising:

a page counter for counting pages printed in the first period; and an after-treatment controller for keeping the toner feeder and the toner agitator operating even after completion of printing when the count of the page counter is no less than a predetermined value.

8. The image recording apparatus according to claim 1, further comprising:

a dot counter for counting light dots irradiated on the photosensitive drum in the first period; and an after-treatment controller for keeping the toner feeder and the toner agitator operating even after completion of printing when the count of the dot counter is no less than a predetermined value.

9. The image recording apparatus according to claim 1, further comprising:

an exposure timer for measuring an exposure time in which the photosensitive drum is exposed to light up to the lapse of the first period; and an after-treatment controller for keeping the toner feeder and the toner agitator operating even after completion of printing when the measured exposure time is no less than a predetermined value.

10. The image recording apparatus according to claim 1, further comprising an after-treatment controller for keeping the toner feeder and the toner agitator operating for an after-treatment period even after completion of printing, the after-treatment period being determined according to the output of the toner sensor generated upon the lapse of the first period.

11. The image recording apparatus according to claim 1, further comprising:

a page counter for counting pages printed in the first period; and an after-treatment controller for keeping the toner feeder and the toner agitator operating for an after-treatment period even after completion of printing, the after-treatment period being determined according to the count of the page counter.

12. The image recording apparatus according to claim 1, further comprising:

a dot counter for counting light dots irradiated on the photosensitive drum in the first period; and an after-treatment controller for keeping the toner feeder and the toner agitator operating for an after-treatment period even after completion of printing, the after-treatment period being determined according to the count of the dot counter.

13. The image recording apparatus according to claim 1, further comprising:

an exposure timer for measuring an exposure time in which the photosensitive drum is exposed to light up to the lapse of the first period; and an after-treatment controller for keeping the toner feeder and the toner agitator operating for an after-treatment period even after completion of printing, the after-treatment period being determined according to the measured exposure time.

14. The image recording apparatus according to claim 1, further comprising an after-treatment controller for keeping the toner feeder and the toner agitator operating for an after-treatment period even after completion of printing when the output of the toner sensor generated upon the lapse of the first period is no less than a predetermined value, the after-treatment period being determined according to the output of the toner sensor.

15. The image recording apparatus according to claim 1, further comprising:

a page counter for counting pages printed in the first period; and an after-treatment controller for keeping the toner feeder and the toner agitator operating for an after-treatment period even after completion of printing when the count of the page counter is no less than a predetermined value, the after-treatment period being determined according to the count of the page counter.

16. The image recording apparatus according to claim 1, further comprising:

a dot counter for counting light dots irradiated on the photosensitive drum in the first period; and an after-treatment controller for keeping the toner feeder and the toner agitator operating for an after-treatment period even after completion of printing when the count of the dot counter is no less than a predetermined value, the after-treatment period being determined according to the count of the dot counter.

17. The image recording apparatus according to claim 1, further comprising:

an exposure timer for measuring an exposure time in which the photosensitive drum is exposed to light up to the lapse of the first period; and an after-treatment controller for keeping the toner feeder and the toner agitator operating for an after-treatment period even after completion of printing when the measured exposure time is no less than a predetermined value, the after-treatment period being determined according to the measured exposure time.

* * * * *